US007997339B2

(12) United States Patent
Mickelburgh et al.

(10) Patent No.: US 7,997,339 B2
(45) Date of Patent: Aug. 16, 2011

(54) CONVEYANCE DEVICE AND METHOD OF USE IN GRAVEL PACK OPERATIONS

(75) Inventors: Ian J Mickelburgh, Cambrils (ES); Gary D. Hurst, Hastings, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/778,503

(22) Filed: May 12, 2010

(65) Prior Publication Data

US 2010/0218948 A1 Sep. 2, 2010

Related U.S. Application Data

(62) Division of application No. 10/906,080, filed on Feb. 2, 2005, now Pat. No. 7,721,801.

(60) Provisional application No. 60/522,133, filed on Aug. 19, 2004.

(51) Int. Cl.
*E03B 3/20* (2006.01)
*E21B 43/08* (2006.01)

(52) U.S. Cl. ..... 166/227; 166/278

(58) Field of Classification Search ..... 166/51, 166/227, 236, 278
See application file for complete search history.

(56) References Cited

U.S. PATENT DOCUMENTS

| | | | | |
|---|---|---|---|---|
| 4,969,523 | A | 11/1990 | Martin et al. | |
| 5,868,200 | A | 2/1999 | Bryant et al. | |
| 6,220,345 | B1 | 4/2001 | Jones et al. | |
| 6,318,465 | B1 | 11/2001 | Coon et al. | |
| 6,513,599 | B1 | 2/2003 | Bixenman et al. | |
| 6,644,406 | B1 | 11/2003 | Jones | |
| 6,715,545 | B2 | 4/2004 | McGregor et al. | |
| 6,830,104 | B2 | 12/2004 | Nguyen et al. | |
| 7,100,691 | B2 | 9/2006 | Nguyen et al. | |
| 2002/0033259 | A1 | 3/2002 | Watson et al. | |
| 2002/0195253 | A1 * | 12/2002 | Hill et al. | 166/380 |
| 2003/0034160 | A1 | 2/2003 | Nguyen et al. | |
| 2003/0183386 | A1 | 10/2003 | McGregor et al. | |
| 2006/0037752 | A1 | 2/2006 | Penno et al. | |

FOREIGN PATENT DOCUMENTS

WO 03/029609 A1 4/2003

* cited by examiner

*Primary Examiner* — Daniel P Stephenson
(74) *Attorney, Agent, or Firm* — David G. Matthews; Rodney V. Warfford

(57) ABSTRACT

The completion assembly includes a conveyance device to bypass regions within a wellbore that may disrupt the desired distribution of gravel in a gravel pack. A packer is attached to an upper tubular, and generally run into wellbore until properly positioned and set near the lower end of upper section. Packer has an extension/crossover to which other lower completion equipment such as a conveyance device and a screen can attach. Conveyance device 22 may include an inner tubular within an outer tubular forming an annular flow path between the inner and outer tubulars. Conveyance device may include one or more discreet flow tubes placed around a lower tubular.

19 Claims, 2 Drawing Sheets

CONVEYANCE DEVICE AND METHOD OF USE IN GRAVEL PACK OPERATIONS

CROSS REFERENCE TO RELATED APPLICATIONS

This application is a divisional of U.S. Patent Application having Ser. No. 10/906,080, filed on Feb. 2, 2005, which claims the benefit of U.S. Provisional Application having Ser. No. 60/522,133, filed on Aug. 19, 2004, which is incorporated by reference herein.

BACKGROUND

1. Field of Invention

The present invention pertains to conveyance devices, and particularly to conveyance devices to bypass a section of a wellbore.

2. Related Art

Gravel packing is often performed in wells having loose or poorly consolidated formations. The gravel placed in the wellbore serves as a filter to prevent the production of sand or fines from the formations. However, for various reasons the gravel packing operation may leave voids in the gravel pack, leading to the undesired sand production.

SUMMARY

The present invention provides for a conveyance device to bypass regions within a wellbore that may disrupt the desired distribution of gravel in a gravel pack.

Advantages and other features of the invention will become apparent from the following description, drawings, and claims.

DETAILED DESCRIPTION

Figure 1:
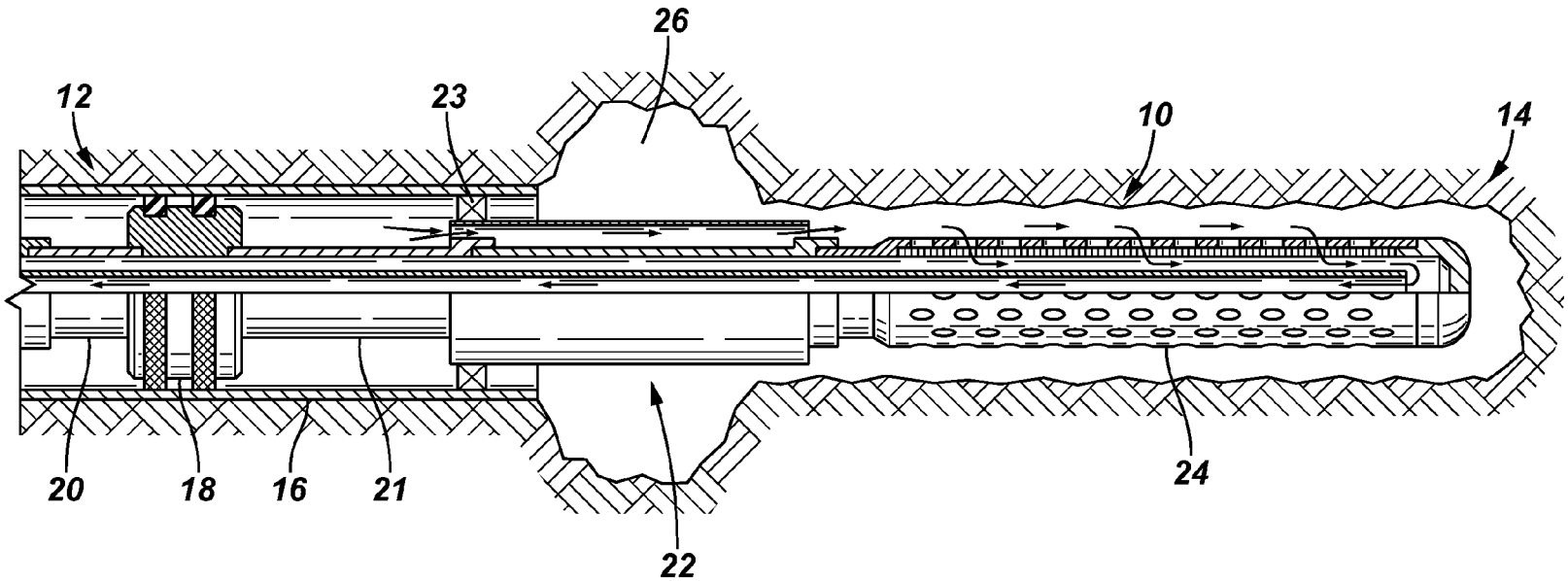
FIG. 1 is a schematic view of wellbore with a service tool therein having a conveyance device in accordance with the present invention.

Referring to FIG. 1, a wellbore 10 is shown having an upper horizontal section 12 and a lower horizontal section 14. A casing 16 lines upper section 12 and lower section 14 is shown as an open hole, though casing 16 could be placed in lower section 14 as well. To the extent casing 16 covers any producing formations, casing 16 must be perforated to provide fluid communication between the formations and wellbore 10.

A packer 18 is attached to an upper tubular 20, and generally run into wellbore 10 until properly positioned and set near the lower end of upper section 12. When packer 18 is set, it engages and seals against casing 16, as is well known in the art. Packer 18 has an extension/crossover 21 to which other lower completion equipment such as a conveyance device 22 and a screen 24 can attach. Screen 24 is preferably disposed adjacent a producing formation in lower section 14.

In the embodiment of FIG. 1, conveyance device 22 is an inner tubular 27 within an outer tubular 28 forming an annular flow path between the inner and outer tubulars. The inner and outer tubulars 27 and 28, respectively, may be concentrically or eccentrically aligned axially and held apart using conventional means such as spars or spacers 30. A partial or total restrictor 23 may be placed between the outer tubular 28 of conveyance device 22 and casing 16 to confine or encourage fluid flow through conveyance device 22. The inner tubular 27 of conveyance device 22 can comprise various structures including blank pipe, screen on perforated pipe, or screen on unperforated pipe. The outer tubular 28 is preferably unperforated pipe.

Figure 2:
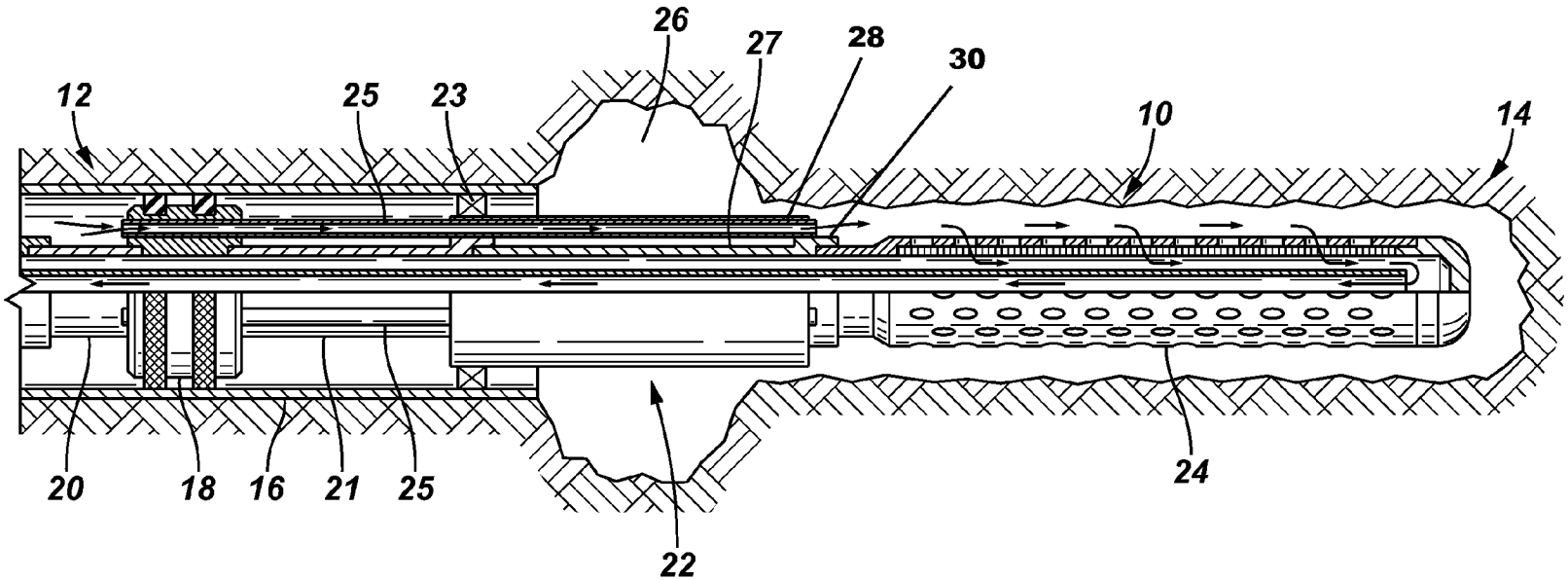
FIG. 2 is a schematic view of an alternative embodiment of the conveyance device of FIG. 1.

In an alternate embodiment (FIG. 2), conveyance device 22 may be one or more discreet flow tubes 25 placed around a lower tubular 27. Again, restrictor 23 may be used to increase flow through the discreet flow tubes 25 of conveyance device 22.

Wellbore 10 often has enlarged regions 26 in various locations within wellbore 10. For example, region 26 may be the result of washout, where the formation has eroded or collapsed. Region 26 may also be intentionally milled to accommodate a window for a lateral bore, or region 26 may occur when the wellbore diameter is reduced at some depth and casing 16 is not landed completely on the bottom or lower end of the larger diameter portion of wellbore 10.

For example, in subsea wells, it is very common to drill a larger diameter upper section 12 and a smaller diameter lower section 14. Typically, the larger diameter section 12 is drilled, and casing 16 is set in place with concrete before drilling the reduced-diameter lower section 14. It is very difficult to land casing 16 exactly on the bottom of upper section 12, and the concrete may not fill in much below casing 16. Thus, an enlarged region 26 is created.

The enlarged region 26 can be a problem when an operator seeks to gravel pack the annulus between screen 24 and wellbore 10. The gravel tends to settle out in region 26, stopping the progress of the gravel pack alpha wave. That can cause the portion of lower section 14 below region 26 not to be packed with gravel.

In operation, gravel is normally transported through a central passageway of upper tubular 20 until it reaches crossover 21 just below packer 18. Gravel exits crossover 21 and tends to pile up and form dunes until it reaches a certain height, depending on slurry speed, sand concentration, and other factors. If restrictors 23 are used, the slurry is discouraged or perhaps even restricted from entering region 26. Instead, the slurry enters and travels through conveyance device 22 until it emerges below region 26. In this way slurry is conveyed past the troublesome region 26 and a more complete gravel pack is achieved in lower section 14. Once lower section 14 is packed with gravel, region 26 may also be filled if sufficient gravel slurry is pumped.

Though described in specific terms using specific components, the invention is not limited to those components. Other elements may be interchangeably used, perhaps with slight modifications to account for variations.

Although only a few example embodiments of the present invention are described in detail above, those skilled in the art will readily appreciate that many modifications are possible in the example embodiments without materially departing from the novel teachings and advantages of this invention. Accordingly, all such modifications are intended to be included within the scope of this invention as defined in the following claims. It is the express intention of the applicant not to invoke 35 U.S.C. §112, paragraph 6 for any limitations of any of the claims herein, except for those in which the claim expressly uses the words 'means for' together with an associated function.

What is claimed is:

1. A completion assembly, comprising:

a packer;

a crossover disposed adjacent the packer;

a conveyance device disposed adjacent the crossover, the conveyance device comprising:

an inner tubular at least partially disposed within an outer tubular to form an annulus therebetween; and one or more flow tubes disposed within the annulus, wherein the one or more flow tubes are longer than the outer tubular;

a restrictor disposed about the outer tubular of the conveyance device; and a sand screen disposed adjacent the conveyance device, wherein the outer tubular of the conveyance device is a solid tubular.

2. The completion assembly of claim 1, wherein the one or more flow tubes extend through the packer.

3. The completion assembly of claim 1, wherein the packer is connected to a first end of the crossover.

4. The completion assembly of claim 1, wherein the crossover is connected to a first end of the conveyance device.

5. The completion assembly of claim 1, wherein the inner tubular of the conveyance device is connected to a first end of the sand screen.

6. The completion assembly of claim 1, wherein the inner tubular is a blank pipe.

7. The completion assembly of claim 1, wherein the inner tubular is separated from the outer tubular by one or more spars or spacers.

8. The completion assembly of claim 1, wherein the inner tubular and outer tubular of the conveyance device are arranged concentrically or eccentrically.

9. The completion assembly of claim 1, wherein the inner tubular is separated from the outer tubular by one or more spars or spacers.

10. A completion assembly, comprising:

a packer;

a crossover disposed adjacent the packer;

a conveyance device disposed adjacent the crossover, the conveyance device comprising:

a solid inner tubular at least partially disposed within a solid outer tubular to form an annulus therebetween;

one or more discreet flow tubes disposed within the annulus; and one or more spacers disposed within the annulus and between the flow tubes; and a sand screen disposed adjacent the conveyance device, wherein the sand screen is connected to the inner tubular of the conveyance device.

11. The completion assembly of claim 10, wherein the packer is disposed on a first end of the crossover.

12. The completion assembly of claim 10, wherein the crossover is disposed on a first end of the conveyance device.

13. A completion assembly, comprising:

a packer;

a crossover disposed adjacent the packer;

a conveyance device disposed adjacent the crossover, the conveyance device comprising:

an inner tubular at least partially disposed within an outer tubular to form an annulus therebetween; and one or more flow tubes disposed within the annulus;

a restrictor disposed about the outer tubular of the conveyance device; and a sand screen disposed adjacent the conveyance device, wherein the outer tubular of the conveyance device is a solid tubular, and wherein the inner tubular of the conveyance device is connected to a first end of the sand screen.

14. The completion assembly of claim 13, wherein the one or more flow tubes extend through the packer.

15. The completion assembly of claim 13, wherein the one or more flow tubes are longer than the outer tubular.

16. The completion assembly of claim 13, wherein the packer is connected to a first end of the crossover.

17. The completion assembly of claim 13, wherein the crossover is connected to a first end of the conveyance device.

18. The completion assembly of claim 13, wherein the inner tubular is a blank pipe.

19. The completion assembly of claim 13, wherein the inner tubular and outer tubular of the conveyance device are arranged concentrically or eccentrically.

* * * * *